US009353745B2

(12) United States Patent
Lee et al.

(10) Patent No.: US 9,353,745 B2
(45) Date of Patent: May 31, 2016

(54) SCROLL COMPRESSOR HAVING A SCROLL SUPPORTER AND/OR MOVEMENT LIMITER

(71) Applicant: LG ELECTRONICS INC., Seoul (KR)

(72) Inventors: Munyoung Lee, Seoul (KR); Sihyun Jang, Seoul (KR); Honggyun Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 220 days.

(21) Appl. No.: 13/949,380

(22) Filed: Jul. 24, 2013

(65) Prior Publication Data

US 2014/0271307 A1 Sep. 18, 2014

(30) Foreign Application Priority Data

Mar. 18, 2013 (KR) ..... 10-2013-0028790

(51) Int. Cl.
*F04C 18/02* (2006.01)
*F04C 27/00* (2006.01)
*F04C 23/00* (2006.01)

(52) U.S. Cl.
CPC ..... *F04C 18/0207* (2013.01); *F04C 18/0215* (2013.01); *F04C 23/008* (2013.01); *F04C 27/005* (2013.01)

(58) Field of Classification Search
CPC ..... F04C 18/0215
See application file for complete search history.

(56) References Cited

U.S. PATENT DOCUMENTS 5,102,316 A 4/1992 Caillat et al.
5,156,539 A 10/1992 Anderson et al.
RE35,216 E 4/1996 Anderson et al.
5,897,306 A * 4/1999 Beck ..... F04C 27/005 418/55.3
6,984,115 B1 1/2006 Tarng et al.
7,300,265 B2 * 11/2007 Stover ..... F04C 18/0215 418/55.1
8,033,803 B2 * 10/2011 Stover ..... F04C 18/0215 277/491
2006/0051227 A1 3/2006 Tarng
2006/0216179 A1 9/2006 Kao
2011/0206548 A1 8/2011 Doepker
2012/0107163 A1 5/2012 Monnier et al.

FOREIGN PATENT DOCUMENTS

CN 1932246 A 3/2007
EP 0 872 641 10/1998
JP 06-026471 1/1994

(Continued)

OTHER PUBLICATIONS

European Search Report dated Apr. 30, 2014.

(Continued)

*Primary Examiner* — Mary A Davis
(74) *Attorney, Agent, or Firm* — Ked & Associates, LLP

(57) ABSTRACT

A scroll compressor having a scroll supporter and/or movement limiter is provided. The scroll compressor may include a casing, a main frame fixedly installed within the casing, a first scroll rotatably supported by the main frame, a second scroll supported by the main frame, such that the second scroll is movable in a vertical direction with respect to the first scroll, a guide that guides movement of the second scroll in the vertical direction, while preventing the second scroll from being rotated in an axial direction; and a movement limiter disposed on an inner wall of the casing and separated from the second scroll, the movement limiter being configured to limit a movement distance of the second scroll in an upward direction.

18 Claims, 7 Drawing Sheets

(56) References Cited

FOREIGN PATENT DOCUMENTS

| | | |
|---|---|---|
| JP | 06-081781 | 3/1994 |
| JP | 08-200248 | 8/1996 |
| KR | 10-0173580 | 10/1998 |
| KR | 10-2001-0049691 | 6/2001 |
| KR | 10-2007-0030111 | 3/2007 |
| KR | 10-2012-0115581 | 10/2012 |
| WO | WO 95/20719 | 8/1995 |

OTHER PUBLICATIONS

Chinese Office Action issued in Application No. 201410099899.7 dated Nov. 2, 2015.

* cited by examiner

SCROLL COMPRESSOR HAVING A SCROLL SUPPORTER AND/OR MOVEMENT LIMITER

CROSS-REFERENCE TO RELATED APPLICATION(S)

This application claims priority to Korean Application No. 10-2013-0028790, filed in Korea on Mar. 18, 2013, the contents of which is incorporated by reference herein in its entirety.

BACKGROUND

1. Field

A compressor, and more particularly, a scroll compressor having a scroll supporter and/or movement limiter is disclosed herein.

2. Background

Scroll compressors are known. However, they suffer from various disadvantages.

A scroll compressor refers to a compressor that utilizes a first or orbital scroll having a spiral wrap and a second or fixed scroll having a spiral wrap, the first scroll performing an orbital motion with respect to the second scroll. While the first scroll and the second scroll are engaged with each other in operation, a capacity of a pressure chamber formed therebetween may be reduced as the first scroll performs the orbital motion. Hence, a pressure of a fluid in the pressure chamber may be increased, and the fluid discharged from a discharge opening formed at a central portion of the second scroll.

The scroll compressor performs a suction process, a compression process and a discharge process consecutively, while the first scroll performs the orbital motion. Because of operational characteristics, the scroll processor may not require a discharge valve and a suction valve in principle, and its structure is simple with a small number of components, thus making it possible to perform a high speed rotation. Further, as the change in torque required for compression is small and the suction and compression processes consecutively performed, the scroll compressor is known to create minimal noise and vibration.

For the scroll compressor, an occurrence of leakage of a refrigerant between the first scroll and the second scroll should be avoided or kept at a minimum, and lubricity (lubrication characteristics) should be enhanced therebetween. In order to prevent a compressed refrigerant from leaking between the first scroll and the second scroll, an end of a wrap portion should be adhered to a surface of a plate portion. On the other hand, in order for the first scroll to smoothly perform an orbital motion with respect to the second scroll, resistance due to friction should be minimized. The relationship between prevention of refrigerant leakage and enhancement of lubricity is contradictory. That is, if the end of the wrap portion and the surface of the plate portion are adhered to each other with an excessive force, leakage may be prevented. However, in such a case, more friction between parts results, thereby increasing noise and abrasion. On the other hand, if the end of the wrap portion and the surface of the plate portion are adhered to each other with less than an adequate sealing force, friction is reduced but lowering of the sealing force results in increase of leakage.

In order to solve such problems, a back pressure chamber having an intermediate pressure between a discharge pressure and a suction pressure may be formed on a rear surface of the first scroll or the second scroll. That is, the first scroll and the second scroll may be adhered to each other with proper force, by forming a back pressure chamber that communicates with a compression chamber having an intermediate pressure, among a plurality of compression chambers formed between the first scroll and the second scroll. With such a configuration, leakage of refrigerant may be prevented and lubricity enhanced.

The back pressure chamber may be positioned on a lower surface of the first scroll or an upper surface of the second scroll. In this case, the scroll compressor with such a back pressure chamber may be referred to as a 'lower back pressure type scroll compressor' or an 'upper back pressure type scroll compressor' for convenience. The structure of the lower back pressure type scroll compressor is simple, and its bypass holes easily formed. However, as the back pressure chamber is positioned on the lower surface of the first scroll, the form and position of the back pressure chamber may change due to the orbital motion. This may cause the first orbital scroll to tilt, resulting in the occurrence of vibration and noise. Further, an O-ring to prevent leakage of compressed refrigerant may be rapidly abraded. The structure of the upper back pressure type scroll compressor is complicated. However, as the back pressure chamber of the upper back pressure type scroll compressor is fixed in form and position, the probability of the second scroll tilting is low, and sealing for the back pressure chamber is excellent.

Korean Patent Application No. 10-2012-7023733, entitled "Compressor including valve assembly", which corresponds to U.S. Patent Pub. No. 2001/0206548, both of which are hereby incorporated by reference, discloses an example of an upper back pressure type scroll compressor. FIG. 1 is a cross-sectional view of an upper back pressure type scroll compressor. In FIG. 1, the scroll compressor 1 includes a first or orbital scroll 30 configured to perform an orbital motion on a main frame 20 fixedly-installed in a casing 10 and a fixed or second scroll 40 engaged with the first scroll 30 to create a plurality of compression chambers upon the orbital motion. A back pressure chamber BP may be formed at an upper portion of the second scroll 40, and a floating plate 60 to seal the back pressure chamber BP may be installed so as to be slidable up and down along an outer circumferential surface of a discharge passage 45. A discharge cover 2 may be installed at an upper surface of the floating plate 60, thereby dividing an inner space of the scroll compressor 1 into a suction space and a discharge space.

A lip seal (not shown) may be installed between the floating plate 60 and the back pressure chamber BP, so that refrigerant may be prevented from leaking from the back pressure chamber BP. The back pressure chamber BP may communicate with one of the plurality of compression chambers, and may be at a receiving end of an intermediate pressure from the plurality of compression chambers. With such a configuration, pressure may be applied upward to the floating plate 60, and pressure may also be applied downward to the second scroll 40. If the floating plate 60 moves upward due to the pressure of the back pressure chamber BP, the discharge space may be sealed as an end of the floating plate contacts the discharge cover 2. In this case, the second scroll 40 may move downward to be adhered to the first scroll 30. With such a configuration, a gap between the second scroll 40 and the first scroll 30 may be effectively sealed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
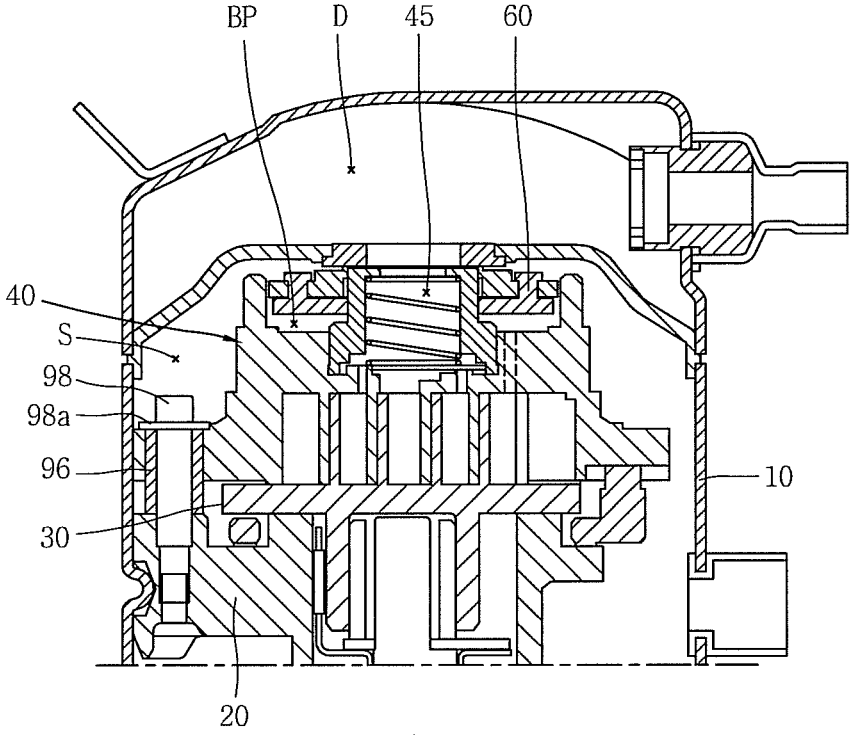
FIG. 1 is a cross-sectional view of a scroll compressor.

Description will now be given in detail of embodiments, with reference to the accompanying drawings. Where possible, like reference numerals have been used to indicate like elements, and repetitive discloser has been omitted.

In the upper back pressure type scroll compressor of FIG. 1, the second scroll is required to move up and down within a limited range. In the example of FIG. 1, the second scroll 40 is fixed with respect to the main frame 20 by using a fastener 98 having a washer portion 98*a*. Namely, a bushing 96 is inserted into an interior of the second scroll 40 and the fastener 98 is inserted to penetrate the bushing 96. Here, an end portion of the fastener 98 is fixed to the main frame 20. Thus, the second scroll 40 moves up and down along an outer surface of the bushing 96. The vertical movement, that is, a range of the vertical movement of the second scroll 40 is limited by the washer portion 98*a*.

With such structure, the second scroll is installed to be movable within a predetermined range, but its fastening structure is complex. Also, as a sufficient area of the bolt fixing part should be secured in order for the main frame to stably support the fastener, the compressor may need to grow in size in a horizontal direction.

Therefore, embodiments disclosed herein provide a scroll compressor in which the second scroll may be easily movable with respect to the main frame.

Embodiments disclosed herein further provide a scroll compressor in which the second scroll may be stably supported without increasing a size of the compressor.

Figure 2:
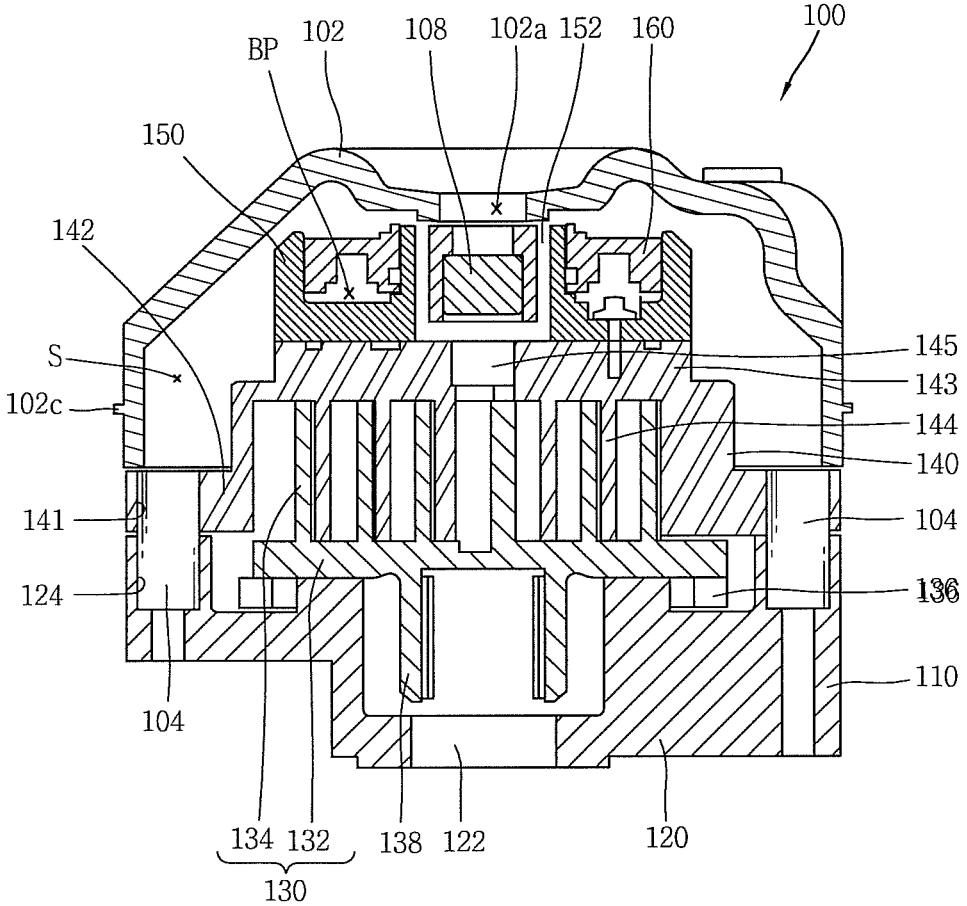
FIG. 2 is a cross-sectional view of a scroll compressor having a scroll supporter according to an embodiment.
Figure 3:
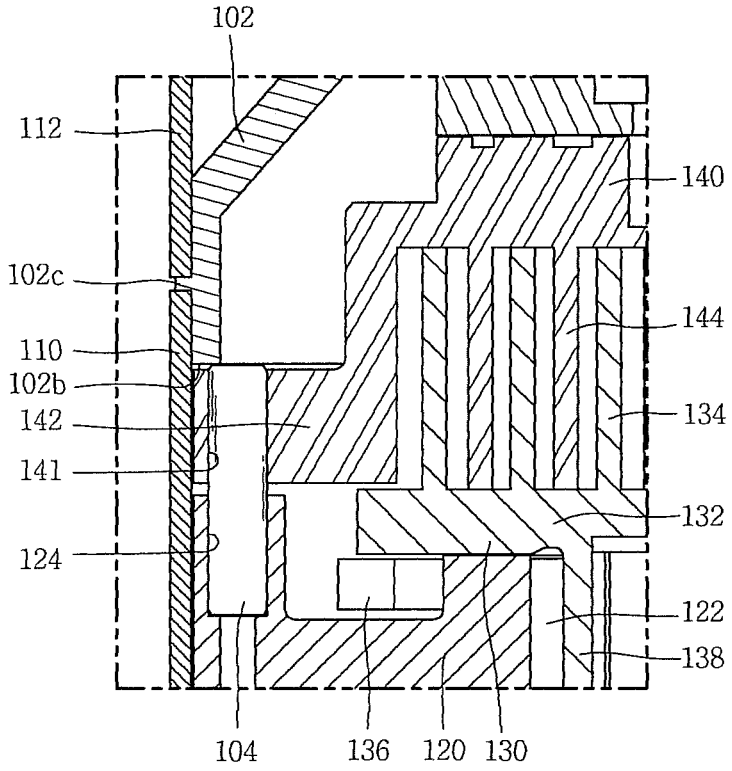
FIG. 3 is an enlarged cross-sectional view of a portion of the scroll compressor of FIG. 2.

FIG. 2 is a cross-sectional view of a scroll compressor having a scroll supporter according to an embodiment. FIG. 3 is an enlarged cross-sectional view of a portion of the scroll compressor of FIG. 2.

Referring to FIGS. 2 and 3, a scroll compressor 100 having a scroll supporter according to an embodiment may include a casing 110. An internal space of the casing 110 may be divided into a suction space S and a discharge space D by a discharge cover 102 installed in an upper portion of the casing 110. An upper side of the discharge cover 102 may correspond to the discharge space D, and a lower side thereof may correspond to the suction space S. A suction port that communicate with the suction space and a discharge port that communicate with the discharge space may be fixed to the casing 110 to draw a refrigerant into the casing 110 or to discharge the refrigerant outside of the casing 110, respectively.

A rotation drive, which may include a stator, a rotor, and a rotational shaft rotated together with the rotor may be disposed in a lower portion of the suction space. Various rotation drives may be employed, so an illustration and description thereof has been omitted.

A main frame 120 that supports one side of the rotational shaft may be fixedly installed to an inner wall of the casing 110. A main bearing 122 may be formed in a lower portion of the main frame 120 to allow the rotational shaft to be inserted therein. An inner wall surface of the main bearing 122 may act as a bearing surface and support the rotational shaft to be smoothly rotated.

A first or orbital scroll 130 may be disposed on an upper surface of the main frame 120. The first scroll 130 may include a plate portion 132, which may have a substantially disk-like shape, and a wrap 134 formed on one surface of the plate portion 132, which may have a spiral shape. The wrap 134 may form a plurality of compression chambers together with a wrap 144 of a second or fixed scroll 140. The plate portion 132 of the first scroll 130 may rotate while being supported by an upper surface of the main frame 120, and an Oldham ring 136 may be installed between the plate portion 132 and the main frame 120 to prevent self-rotation of the first scroll 130. The rotational shaft may be inserted into a boss portion 138 formed on a lower surface of the plate portion 132 of the first scroll 130, and a rotating force of the rotational shaft may rotate the first scroll 130.

The second scroll 140 engaged with the first scroll 130 may be disposed in or at an upper portion of the first scroll 130. An upper surface of the second scroll 140 may have a disk-like shape to form a plate portion 143. The wrap 144 engaged with the wrap 134 of the first scroll 130 may be formed at a lower portion of the plate portion 143. The wrap 144 may have a predetermined spiral shape, and a discharge opening may be formed in a substantially central portion of the plate portion 143 to allow a compressed refrigerant to be discharged therethrough. In addition, a suction opening (not shown) may be formed on or in a lateral surface of the fixed scroll 140, whereby a refrigerant may be sucked through the suction opening according to an interaction between the wrap 144 and the wrap 134.

As described above, the wrap 144 and the wrap 134 may form a plurality of compression chambers, and as the compression chambers are rotatably moved toward the discharge opening, a volume thereof may be reduced to compress a refrigerant. Thus, a suction pressure of a compression chamber adjacent to the suction opening may be maintained at a minimum, a discharge pressure of a compression chamber that communicates with the discharge opening 145 may be maintained at a maximum, and an intermediate pressure of a compression chamber existing therebetween may be maintained at an average between the suction pressure of the suction opening and the discharge pressure of the discharge opening 145. The intermediate pressure may be applied to a back pressure chamber (BP), which is described hereinbelow, to press the second scroll 140 toward the first scroll 130.

A back pressure plate 150 may be fixed to an upper portion of the plate portion 143 of the second scroll 140. The back pressure plate 150 may have a substantially annular shape and form the back pressure chamber BP together with a floating plate 160. A discharge flow path connected with the discharge opening 145 may be formed in a central portion of the back pressure plate 150, and a check valve 108, which may have a cylindrical shape, may be disposed within the discharge flow path. In more detail, the check valve 108 may have a lower end portion having a size sufficient to completely cover the discharge opening 145, and thus, when the check valve 108 is in contact with the plate portion 143 of the second scroll 140, the check valve 108 may close the discharge opening 145.

Also, an intermediate discharge opening 152 may be formed in an upper end of a substantially central portion of the back pressure plate 150. The intermediate discharge opening 152 may provide a flow path that allows a refrigerant discharged through the discharge opening 145 to flow (or move) to the discharge space, and the refrigerant discharged through the intermediate discharge opening 152 may be discharged to the discharge space through a through hole 102*a* formed in the discharge cover 102.

As described above, the second scroll 140, while moving in a vertical direction according to pressure of the back pressure chamber BP, may seal a gap between the second scroll 140 and the first scroll 130. The second scroll 140 may be installed to be movable in a vertical direction with respect to the first scroll 130. In more detail, guide pins 104 may be inserted into the main frame 120 through corresponding guide holes 141 formed on an outer circumferential portion of the second scroll 140. Thus, by virtue of the guide pins 104, the second scroll 140 may be restrained from rotating with respect to the main frame 120, and movement thereof in a vertical direction may be guided.

The guide holes 141 may be formed in pin insertion portions 142 that protrude from an outer circumferential surface of a body portion of the second scroll 140, respectively. The amount of the guide pins 104 or pin insertion portions 142 may be arbitrarily set, and is not necessarily limited to three as shown. The pin insertion portions 142 may be formed on an upper portion of a pin fixing portion 124 formed on an outer circumferential portion of the main frame 120.

The pin fixing portion 124 may protrude upwardly from an outer circumference of the Oldham ring 136, and an upper surface thereof may form a support surface that supports the pin insertion portion 142. Also, the guide pin 104 may be inserted into the pin fixing portion 124. The guide pin 104 may be strongly fastened to the pin fixing portion 124, such that it cannot be moved, or may be inserted such that it may slide or rotate in a vertical direction.

An upper end portion of the guide pin 104 may be disposed to be in contact with a lower end portion 102*b* of the discharge cover 102. That is, the guide pin 104 may be disposed such that it is prevented from moving upwardly by the discharge cover 102. Thus, although the guide pin 104 is not fixed, it cannot be separated from the pin fixing portion 124, as the movement of the guide pin 104 is restricted by the discharge cover 102 and at the same time guided by the guide hole 141.

An upper surface of the pin insertion portion 142 of the second scroll 140 may be positioned to be slightly lower than an upper end portion of the guide pin 104. As described above, as an end portion 102*b* of the discharge cover 102 is in contact with the upper portion of the guide pin 104, the second scroll 140 may be moved upwardly until it comes into contact with the end portion 102*b* of the discharge cover 102. Thus, the end portion 102*b* of the discharge cover 102 may serve as a movement limiter that limits movement of the fixed scroll 140. A protrusion length of the guide pin 104 may determine an amount of movement or a room for movement of the second scroll 140.

A flange 102*c* may be formed on or at an outer circumferential side of the discharge cover 102 and placed on an upper end portion of the casing 110. The flange 102*c* may serve as a device that limits a depth by which the discharge cover 102 may be inserted, and may also serve to combine the discharge cover 102 to the casing 110 together with a top cover 112, which may be attached, for example, welded to an upper portion of the casing 110.

Thus, while the guide pin 104 is inserted into the main frame 120, the guide pin 104 may also be inserted into an interior of the guide hole 141 of the pin insertion portion 142 of the fixed scroll 140, and the discharge cover 102 may subsequently be inserted into the casing 110, thus completing installation of the fixed scroll 140. In addition, as there is no need to strongly fasten the guide pin 104 to the main frame 120, the pin fixing portion 124 may not need to be large.

Figure 4:
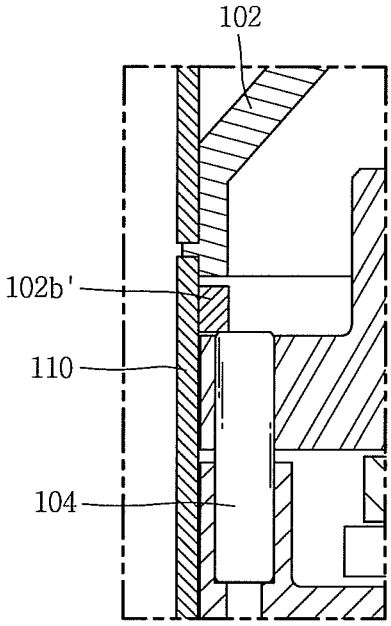
FIG. 4 is a cross-sectional view of a movement limiter of FIG. 2.

In the above-discussed embodiment, the movement limiter is integrally formed with the discharge cover 120; however, embodiments are not so limited. Namely, as illustrated in FIG. 4, with one embodiment, aside from the discharge cover 102, a ring 102*b*' fixed to an inner wall of the casing 110 may be formed as the movement limiter.

Figure 5:
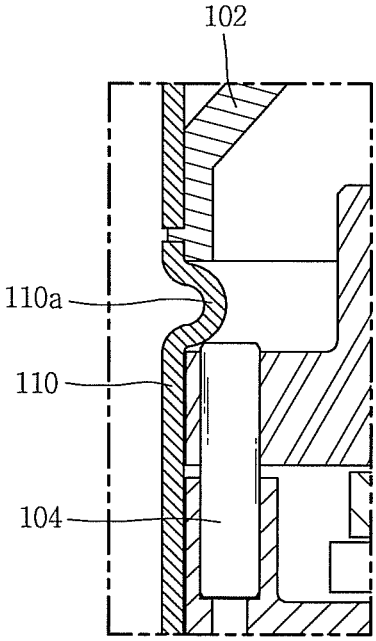
FIG. 5 is a cross-sectional view of a movement limiter according to another embodiment.

Also, as illustrated in FIG. 5, according to one embodiment, a portion of an inner wall of the casing 110 may be modified to form a protrusion portion 110*a* to form the movement limiter.

With the first embodiment, the guide pin is employed as a device to prevent rotation of the fixed scroll as well as to guide vertical movement of the fixed scroll; however, embodiments are not so limited. That is, according to one embodiment, a rotation preventer and a guide may be separately provided.

Figure 6:
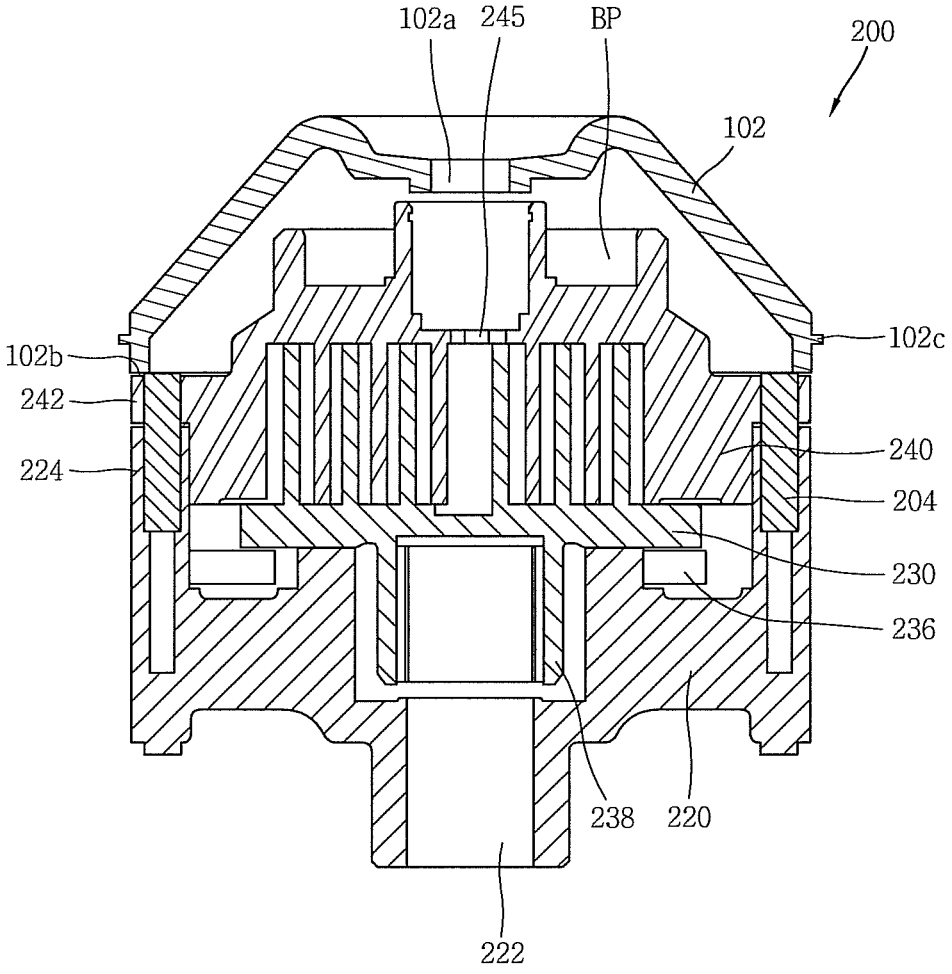
FIG. 6 is a cross-sectional view of a scroll compressor having a second scroll supporter according to another embodiment.
Figure 7:
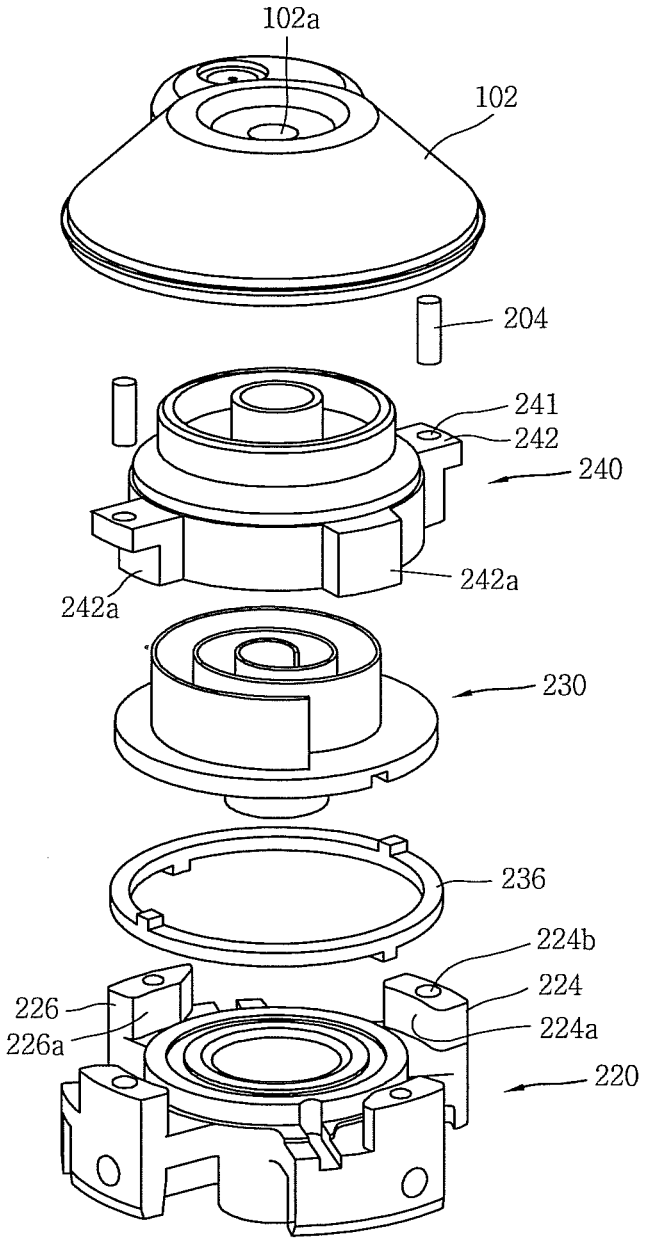
FIG. 7 is an exploded perspective view of the scroll compressor of FIG. 6.

FIGS. 6 and 7 are a cross-sectional view and an exploded perspective view of a scroll compressor according to another embodiment, in which a rotation preventer and a guide are provided separately. Referring to FIGS. 6 and 7, a scroll compressor 200 according to this embodiment may include a discharge cover 102 provided on an upper end portion and a main frame 220 installed on an inner wall of the casing 110. A main bearing 222 may be provided in a lower portion of the main frame 220, and a first scroll 230 may be installed at an upper portion of the main frame 220, such that it is rotatably driven. A boss portion 238, which may be combined with an end portion of a rotational shaft, may be formed at a lower portion of the first scroll 230. In addition, in order to prevent self-rotation of the first scroll 230, an Oldham ring 236 may be interposed between the first scroll 230 and the main frame 220.

A second scroll 240 engaged with the first scroll 230 may be disposed in or at an upper portion of the first scroll 230. A discharge opening 245 may be formed in a substantially central portion of the second scroll 240 to allow a compressed refrigerant to be discharged therethrough. With this embodiment, a back pressure chamber BP may be provided in an upper portion of the second scroll 240. Unlike the previous embodiments, the back pressure chamber BP may be integrally formed with the second scroll 240; however, embodiments are not so limited. The back pressure chamber may also be formed as a separate member as in the previous embodiments. Reversely, also, with the previous embodiments, the back pressure chamber may be integrally formed.

Meanwhile, pin fixing portions 224 and auxiliary guide portions 226 may be formed in the main frame 220, such that they protrude upwardly toward the discharge cover 102. A guide surface 224*a* may be formed on an inner surface of the pin fixing portion 224, such that it faces an outer guide surface of the fixed scroll 240 as described hereinbelow. In addition, a pin fixing hole 224*b* may be formed on an upper surface of the pin fixing portion 224 to allow a guide pin 204 to be inserted therein. The guide pin 204 may be inserted into the pin fixing hole 224*b*. Also, the auxiliary guide 226 may have a guide surface 226*a* that plays the same role as that of the guide surface 224*a*.

A guide hole 241 may be formed on a lateral surface of the second scroll 240 to allow the guide pin 204 to be inserted therein to prevent the second scroll 240 from rotating. The guide hole 241 may penetrate pin insertion portions 242 to protrude outwardly from the second scroll 240.

Here, as illustrated in FIG. 6, an upper end portion of the guide pin 204 may be spaced apart from a lower surface 102*b* of the discharge cover 102, and positioned to be higher than a surface of the pin insertion portion 242. However, in an alternative embodiment, the upper end portion of the guide pin 204 may be positioned lower than the surface of the pin insertion portion 242. Thus, the guide pin 204 and the guide hole 241 may serve to guide a movement of the second scroll 240 in a vertical direction, but they mainly serve to prevent a rotation of the second scroll 240.

Four outer guide surfaces 242*a* formed on a lateral surface of the second scroll 240 may guide a vertical movement of the second scroll 240 by four guide surfaces 224*a* and 226*a* provided in the main frame 220. A lower end portion 102*b* of the discharge cover 102 may be disposed to be spaced from an upper surface of the pin insertion portion 242 by a predetermined distance, and the distance may determine a movement distance of the second scroll 240 in an upward direction.

In this embodiment, as the guide and the rotation preventer are separately provided, rotation of the second scroll 240 may be prevented and vertical movement of the second scroll 240 more stably guided. According to this embodiment, the movement limiter having a configuration as illustrated in FIGS. 4 and 5 may be instead used as the movement limiter.

Figure 8:
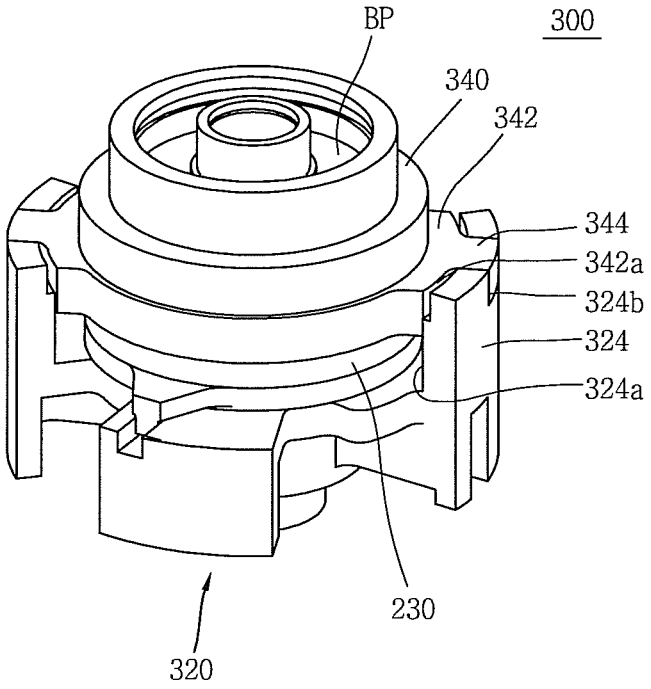
FIG. 8 is a perspective view of a scroll compressor having a second scroll supporter according to yet another embodiment.

FIG. 8 is a perspective view of a scroll compressor according to another embodiment in which a rotation preventer and a guide are separately provided. In describing the scroll compressor according to this embodiment, like components as those of the previous embodiment have been given the same reference numerals and repetitive disclosure has been omitted. Referring to FIG. 8, a scroll compressor 300 according to this embodiment may include two key recess portions 324 formed to protrude upwardly from both sides of a main frame 320.

The key recess portions 324 may be formed to extend in an arc shape, and have guide surfaces 324*a* formed at an inner side thereof and face outer guide surfaces formed in a second scroll 340. An upper end portion of the guide surface 324*a* may protrude toward the second scroll 340 to have a step-like shape. Also, a key recess 324*b* having a substantially quadrangular section may be formed on an upper surface of each of the key recess portions 324.

The second scroll 340 may have two guide portions 342. An outer circumferential surface of the guide portion 342 may serve as an outer guide surface 342*a* facing the guide surface 324*a*, and a portion adjacent to a lower end portion of the outer guide surface 342*a* may face the guide surface 324*a* to guide a vertical movement of the second scroll 340. Also, a key 344 may be formed on an outer circumferential surface of the guide portion 342 and be inserted into the key recess 324*b*.

The key 344 may be inserted into the key recess 324*b* to serve as a rotation preventer to prevent rotation of the second scroll 340. A lower end portion 102*b* of the discharge cover 102 may be positioned to be adjacent to an upper surface of the key 344 to limit an upward movement distance of the second scroll 340.

With this embodiment, as the key(s) integrally formed with the second scroll is used, the number of components may be reduced, and thus, manufacturing costs may be reduced and a manufacturing process of the compressor may be further simplified. According to this embodiment, the movement limiter having such a configuration as illustrated in FIGS. 4 and 5 may be used instead. Also, the second scroll 340 may include a separately installed back pressure plate as is illustrated in the previous embodiments.

Embodiments disclosed herein provide an apparatus of a scroll compressor and a method thereof. Further, embodiments disclosed herein provide a scroll compressor, having a fixed or second scroll supporter that may include a casing, a main frame fixedly installed within the casing, an orbital or second scroll rotated in a state of being supported by the main frame, a fixed or second scroll supported by the main frame, such that the fixed scroll is movable in a vertical direction with respect to the orbital scroll, a guide unit or guide that guides a movement of the fixed scroll in the vertical direction, while preventing the fixed scroll from being rotated in an axial direction; and a movement limiting unit or limiter disposed on an inner wall of the casing and separated from the fixed scroll, and the movement limiting unit being configured to limit a movement distance of the fixed scroll in an upward direction.

Embodiments disclosed herein provide a scroll compressor that may include a casing; a main frame fixedly installed within the casing; an orbital or first scroll rotated in a state of being supported by the main frame; a fixed or second scroll supported by the main frame, such that the fixed scroll is movable in a vertical direction with respect to the orbital scroll; a guide unit or guide that guides a movement of the fixed scroll in the vertical direction, while preventing the fixed scroll from being rotated in an axial direction; and a movement limiting unit or limiter brought into contact with the fixed scroll when the fixed scroll is moved upwardly, in order to limit a movement distance of the fixed scroll in an upward direction, disposed on an inner wall of the casing, such that it is separated from the fixed scroll.

The guide unit may prevent rotation of the fixed scroll and guides a vertical movement of the fixed scroll. The movement limiting unit, aside from the guide unit, may be installed on an inner wall of the casing to limit a movement of the fixed scroll. As the movement limiting unit is not installed in the main frame, there is no need to increase a size of the main frame, and as the guide unit is not required to support the fixed scroll and only serves to guide a movement of the fixed scroll, fastening strength with respect to the main frame is not required to be strong. Thus, the fixed scroll may be easily installed.

The scroll compressor may further include a discharge cover fixed within the casing, dividing the interior of the casing into a suction space and a discharge space, and installed to be spaced apart upwardly from the fixed scroll. The movement limiting unit may extend along an inner wall surface of the casing from a lower surface of the discharge cover. As the movement limiting unit may be integrally formed with the discharge cover, there may be no need to install a separate movement limiting unit, simplifying an operation of installing the fixed scroll.

The movement limiting unit may have an annular shape fixed to an inner wall surface of the casing, or may be formed to protrude from the inner wall surface of the casing. A portion of the casing may inwardly protrude to form the movement limiting unit.

Meanwhile, the guide may include a guide pin inserted by passing through the main frame and the fixed scroll. The main frame may include a pin fixing portion that allows the guide pin to be inserted therein. The fixed scroll may include a pin insertion portion installed in an upper portion of the pin fixing portion and having a pin hole allowing the guide pin inserted therein. The pin insertion portion may extend in a radial direction from a lateral surface of the fixed scroll.

The fixed scroll may move upwardly until when the pin insertion portion comes into contact with a lower end portion of the movement limiting unit. The movement limiting unit may be disposed to be in contact with an upper portion of the guide pin. As the guide pin is fixed by the movement limitation unit, the guide pin may be more easily fixed.

Embodiments disclosed herein further provide a scroll compressor that may include a casing; a main frame fixedly installed within the casing; an orbital or first scroll rotated in a state of being supported by the main frame; a fixed or second scroll supported by the main frame such that the fixed scroll is movable in a vertical direction with respect to the orbital scroll; a rotation preventing unit or preventor that prevents a rotation of the fixed scroll in an axial direction; a guide unit or guide that guides a movement of the fixed scroll in a vertical direction; and a movement limiting unit or limiter brought into contact with the fixed scroll when the fixed scroll is moved upwardly, in order to limit a movement distance of the fixed scroll in an upward direction, disposed on an inner wall of the casing such that it is separated from the fixed scroll.

The rotation preventing unit, which may be configured to prevent rotation of the fixed scroll, and the guide unit, which may be configured to guide a movement of the fixed scroll in a vertical direction, may be separately provided on lateral surfaces, thereby enhancing a rotation preventing and guiding function.

The scroll compressor may further include a discharge cover fixed within the casing, dividing the interior of the casing into a suction space and a discharge space, and installed to be spaced apart upwardly from the fixed scroll. The movement limiting unit may extend along an inner wall surface of the casing from a lower surface of the discharge cover. The movement limiting unit may have an annular shape fixed to an inner wall surface of the casing, or may be formed to be protruded from the inner wall surface of the casing.

The rotation preventing unit may include a guide pin inserted by passing through the main frame and the fixed scroll. The main frame may include a pin fixing portion that allows the guide pin to be fixed thereto, and the guide unit may include a guide surface provided at an inner side of the pin fixing portion and disposed to be in contact with a lateral surface of the fixed scroll.

The rotation preventing unit may include a key recess formed in the main frame, and a key formed in the fixed scroll and inserted into the key recess such that it is movable in a vertical direction. The main frame may include a key recess formation portion including the key recess that protrudes toward the fixed scroll, and the guide unit may include a guide surface provided at an inner side of the key recess formation portion and disposed to be in contact with a lateral surface of the fixed scroll.

As the movement limiting unit is not installed in the main frame, there is no need to increase a size of the main frame. Also, as the guide unit serves only to guide a movement of the fixed scroll, rather than serving to fasten the fixed scroll, the guide unit may be fixed to the main frame with a lower level of fastening strength, facilitating an installation of the fixed scroll.

Also, as the movement limiting unit may be integrally formed with the discharge cover, there is no need to install an additional movement limiting unit, further simplifying the operation of installing the fixed scroll.

In addition, as the rotation preventing unit, which prevents rotation of the fixed scroll, and the guide unit, which guides a movement of the fixed scroll in a vertical direction, may be separately provided, the rotation preventing and guiding function may be further enhanced.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a main frame fixedly installed within the casing;

a first scroll rotatably supported by the main frame;

a second scroll supported by the main frame, such that the second scroll is movable in a vertical direction with respect to the first scroll;

a rotation preventer that prevents rotation of the second scroll in an axial direction;

a guide that guides movement of the second scroll in a vertical direction; and a movement limiter provided on an inner wall of the casing separated from the second scroll, the movement limiter being configured to limit a movement distance of the second scroll in an upward direction, wherein the main frame includes at least one protrusion, that protrudes toward the second scroll in a vertical direction, and wherein the guide includes:

a first guide surface formed on an inner side of the at least one protrusion; and a second guide surface formed on a lateral surface of the second scroll and provided to be in contact with the first guide surface.

2. The scroll compressor of claim 1, wherein the guide is not fixed to the first scroll.

3. The scroll compressor of claim 1, further including a discharge cover provided within the casing above the second scroll, the discharge cover dividing an interior of the casing into a suction space and a discharge space, wherein the movement limiter extends along an inner wall surface of the casing from a lower surface of the discharge cover.

4. The scroll compressor of claim 1, wherein the movement limiter has an annular shape and is fixed to an inner wall surface of the casing.

5. The scroll compressor of claim 1, wherein the movement limiter protrudes from the inner wall surface of the casing.

6. The scroll compressor of claim 1, wherein the rotation preventer includes a guide pin inserted through the main frame and the second scroll.

7. The scroll compressor of claim 6, wherein a lower end of the guide pin is inserted into a pin fixing hole provided in the at least one protrusion, and an upper end of the guide pin is in contact with the movement limiter in the vertical direction.

8. The scroll compressor of claim 1, wherein the rotation preventer includes:

a key recess formed in the at least one protrusion; and a key formed in the second scroll and inserted into the key recess, wherein the key is movable in the vertical direction.

9. A scroll compressor, comprising:

a casing;

a main frame fixedly installed within the casing, including at least one protrusion that protrudes in an axial direction;

a first scroll rotatably supported by the main frame;

a second scroll supported by the main frame, such that the second scroll is movable in a vertical direction with respect to the first scroll, wherein the second scroll includes a pin insertion portion installed at an upper portion of the at least one protrusion;

a guide pin inserted through the at least one protrusion of the main frame and the pin insertion portion of the second scroll that prevents the second scroll from being rotated in an axial direction;

a movement limiter provided on an inner wall of the casing and not attached to the second scroll, the movement limiter being configured to limit a movement distance of the second scroll in an upward direction;

a first guide surface formed on an inner side of the at least one protrusion; and a second guide surface formed on a lateral surface of pin insertion portion and provided to be in contact with the first guide surface.

10. The scroll compressor of claim 9, wherein the pin insertion portion is not fixed to the first scroll.

11. The scroll compressor of claim 9, further including a discharge cover provided within the casing above the second scroll, the discharge cover dividing an interior of the casing into a suction space and a discharge space, wherein the movement limiter extends along an inner wall surface of the casing from a lower surface of the discharge cover.

12. The scroll compressor of claim 9, wherein the movement limiter has an annular shape and is fixed to an inner wall surface of the casing.

13. The scroll compressor of claim 9, wherein the movement limiter protrudes from the inner wall surface of the casing.

14. The scroll compressor of claim 9, wherein the guide pin is inserted into a pin hole formed on the pin insertion portion.

15. The scroll compressor of claim 14, wherein the pin insertion portion extends in a radial direction from a lateral surface of the second scroll.

16. The scroll compressor of claim 15, wherein the second scroll moves upwardly until the pin insertion portion comes into contact with a lower end of the movement limiter.

17. The scroll compressor of claim 16, wherein the movement limiter is disposed to be in contact with an upper portion of the guide pin.

18. The scroll compressor of claim 9, wherein a lower end of the guide pin is inserted into a pin fixing hole provided in the at least one protrusion, and an upper end of the guide pin is in contact with the movement limiter in a vertical direction.

* * * * *